United States Patent [19]

Tatavoosian

[11] Patent Number: 4,967,328

[45] Date of Patent: Oct. 30, 1990

[54] OMNIDIRECTIONAL SHOCK ABSORBING LAMP MOUNTING SYSTEM FOR ILLUMINATED APPARATUS

[75] Inventor: Vanacan Tatavoosian, Mission Viejo, Calif.

[73] Assignee: Eaton Corporation, Cleveland, Ohio

[21] Appl. No.: 497,454

[22] Filed: Mar. 22, 1990

[51] Int. Cl.[5] ..... F21V 21/00

[52] U.S. Cl. ..... 362/267; 362/369; 362/390; 439/382; 439/558; 439/548

[58] Field of Search ..... 362/249, 240, 267, 268, 362/293, 369, 390; 439/382, 384, 385, 541, 548, 556, 558

[56] References Cited

U.S. PATENT DOCUMENTS 2,620,434 12/1952 Edmunds ..... 362/369

2,681,979 6/1954 Manoloff ..... 362/369

*Primary Examiner*—Carroll B. Dority

*Attorney, Agent, or Firm*—L. G. Vande Zande

[57] ABSTRACT

A rubber ring disposed snugly over the glass envelope of a lamp and slid against a larger cylindrical lamp body centers and spaces the lamp within a reflector hole by positioning the ring within a counterbore recess in a back surface of the reflector concentric with the hole. The height of the ring is greater than the depth of the counterbore recess to space the lamp body away from the back surface of the reflector. A rubber strip is disposed between the opposite end of the lamp body and a housing member, the strip and ring being compressed in assembly to resiliently support the lamp, absorbing vibration and shock forces imparted to the lamp through the housing.

14 Claims, 1 Drawing Sheet

FIG 1
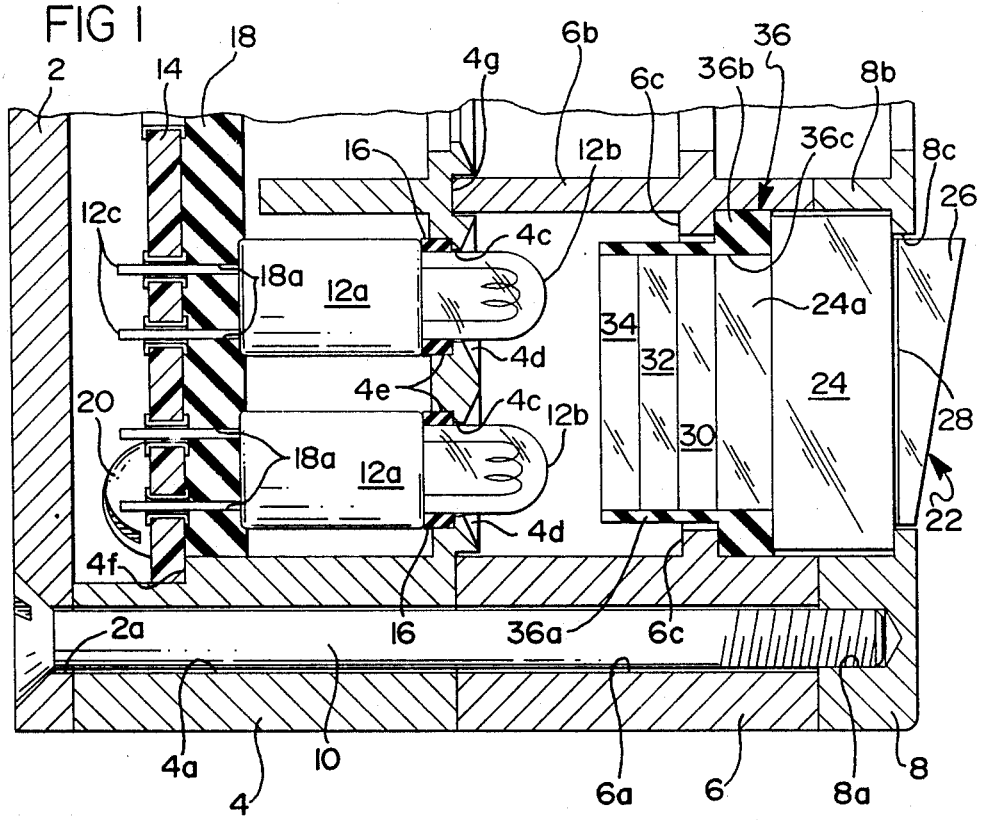
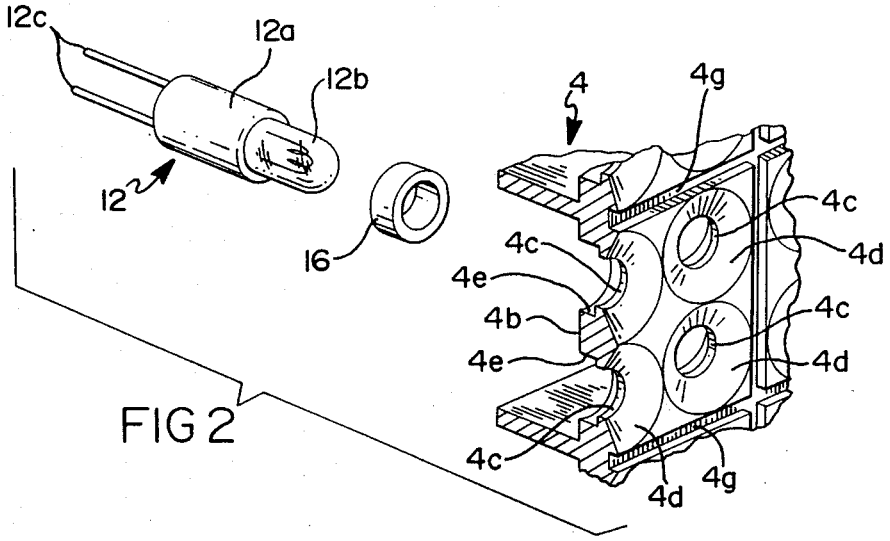
FIG 2

OMNIDIRECTIONAL SHOCK ABSORBING LAMP MOUNTING SYSTEM FOR ILLUMINATED APPARATUS

CROSS-REFERENCE TO RELATED APPLICATION

This application is related to copending application Ser. No. 497,372 filed concurrently herewith in the names of Vanacan Tatavoosian and George E. Schaeffer entitled Lens Mounting and Seal for Illuminated Apparatus and assigned to the assignee of this application.

BACKGROUND OF THE INVENTION

This invention relates to a shock absorbing mounting system for lamps. Particularly, this invention relates to a mounting system of the aforedescribed type for lamps used to illuminate switching apparatus, indicating apparatus or panels. More particularly, this invention relates to such apparatus used as annunciator panels on board aircraft.

Lamps used to illuminate panels and annunciator apparatus are physically small but of high intensity. The thin filaments in such lamps are highly susceptible to shorting due to bending or breakage from vibration and shock, each of which are prevalent when the illuminated apparatus is used on movable equipment such as vehicles, aircraft and the like. Moreover, temperature changes cause thermal expansion and contraction of the components of the apparatus. Variations in rate and amount of expansion of dissimilar materials of lamp and housing components of the apparatus result in failure of the apparatus due to broken elements or broken electrical connections.

SUMMARY OF THE INVENTION

This invention provides an omnidirectional shock absorbing lamp mounting system wherein a lamp body is suspended by resilient mounting elements bearing against opposite ends of the lamp body in compression. One resilient mounting element is positioned at a back surface of a reflector having an opening through which a glass tube of the lamp extends, the mounting element cooperating with positioning means on the reflector to maintain the glass tube of the lamp centered within the opening, spaced from edges of the opening. Damaging affects of variations in thermal expansion by dissimilar materials of the apparatus are shielded from the lamp by the resilient mounting.

The foregoing and other features and advantages of this invention will become readily apparent and understood when reading the following description and appended claims in conjunction with the accompanying drawings.

BRIEF DESCRIPTION OF THE DRAWINGS

FIG. 1 is a cross sectional view of an illuminated indicator device having an omnidirectional shock absorbing lamp mounting system constructed in accordance with this invention; and FIG. 2 is an exploded perspective view of certain components of the lamp mounting system of FIG. 1.

DETAILED DESCRIPTION OF THE PREFERRED EMBODIMENT

Illuminated apparatus according to this invention may be an individual device or, as shown in the drawings, may be one pocket of a multi-pocket indicator panel, referred to in the aircraft industry as an annunciator panel. The panel comprises a rear cover 2, a base 4, a lens mounting section 6 and a bezel 8 all secured together in stacked relation to form a housing for the device by a plurality of screws 10 (only one shown) which pass through countersunk clearance holes 2a in back cover 2 and aligned clearance holes 4a and 6a in base 4 and lens mounting section 6 to engage blind threaded holes 8a in the back surface of bezel 8.

Base 4 has a front wall 4b continuous to all pockets in the panel. A plurality of openings 4c are provided in front wall 4b, one or more openings 4c being provided for each pocket. The front surface of wall 4b has reflector surfaces 4d formed generally concentric with the respective holes 4c for reflecting light forward in the device. Surfaces 4d may be beveled, frusto-conical (as shown in the drawings), faceted, curved, parabolic, or the like as desired. Moreover, the front surface of front wall 4b may be plated with a bright material providing a highly reflective surface.

A lamp 12 is provided for each opening 4c, the individual lamp comprising a cylindrical main body 12a and a reduced diameter tubular glass envelope 12b extending from one end of body 12a and disposed through the respective opening 4c. Lamps 12 are trapped between wall 4b and a rigid back member, e.g. a printed circuit board 14 providing electrical connection with leads 12c of the respective lamps.

A right cylinder rubber ring 16 is disposed over the tubular glass envelope 12b of lamp 12 and slid into abutting engagement with the main body 12a. Ring 16 is sized fit snuggly on the tubular glass envelope 12b and may be slightly elastically stretched when so assembled. However, it is not necessary for the ring 16 to fit tightly around the envelope 12b, exerting inward radial force thereon. A rubber strip 18 is positioned against the forward surface of printed circuit board 14 to bear directly against the back ends of lamp 12. The strip 18 may have openings 18a which permit the passage of lamp leads 12c therethrough or the strip may be of a sufficiently porous rubber to permit the leads 12c to pierce the rubber strip.

The back side of wall 4b of base 4 is provided with counterbores 4e concentric with each respective hole 4c. The outer diameter of rubber ring 16 is only minimally smaller than the diameter of counterbores 4e such that the lamp 12 with rubber ring 16 assembled thereto may be readily inserted through the opening 4c from the rear of wall 4b. The cooperation between counterbore 4e and rubber ring 16 positions the lamp 12 concentrically with respect to opening 4c, maintaining a uniform space between glass envelope 12b and opening 4c. It should be recognized that other forms of positioning means may be used on the back surface of wall 4b, such as a ring-shaped boss or an arrangement of individual bosses. As seen in FIG. 1, the height, distance along the axis, of rubber ring 16 is greater than the depth of counterbore 4e, thereby spacing the forward end of lamp body 12a away from the rear surface of wall 4b.

Printed circuit board 14 is secured within housing 4 by a screw 20 which passes through an associated clearance hole (not shown) in the printed circuit board 14 and threadably engages in a hole (not shown) in housing 4, securing the printed circuit board 14 against a rearwardly facing shoulder 4f of housing 4. With the printed circuit board 14 so mounted, rubber strip 18 and rubber ring 16 are compressed by the ends of lamp bodies 12*a*. Lamps 12 are fully resiliently supported within the housing to absorb or at least minimize vibration and mechanical shock imparted to the lamp, and particularly to its filament, through the housing which is secured directly to a vehicle or aircraft chassis. The annular ring 16 cushions against shock or vibration in all radial directions as well as forward and backward in the axial direction in cooperation with rubber strip 18. Vibration or shock forces in any composite direction are also absorbed by the above described mounting system. The only direct connection of the lamp to a member rigid with the housing is the connection between the printed circuit board and the lamp leads 12*c*. The length and diameter of these leads provide significant resiliency to the lamp body and filament, and the strip 18 provides a dampening action on any vibration set up in the lamp leads within the boundaries of the strip 18.

Wall 4*b* of base 4 and lens mounting section 6 are divided into a pattern of aligned pockets by forwardly extending walls 6*b* in section 6 which nest within corresponding grooves 4*g* in the front face of wall 4*b*. A continuous flange 6*c* is formed on the respective walls 6*b* to extend around the entire interior periphery of each pocket of lens mounting section 6. Bezel 8 is provided with a plurality of rearwardly extending walls 8*b* which coincide with the walls 6*b* to complete the plurality of pockets, each defining an illuminated indicator device. The front face of bezel 8 is provided with openings 8*c* which are centered within the respective pocket defined by the walls 8*b*.

A lens assembly 22 comprises a substantially rectangular transparent lens member 24 having a stepped down rear rectangular projection 24*a*. A reduced size or stepped down trapizoidally shaped transparent member 26 is bonded to a front face of lens 24. Indicia bearing the caption for the illuminated indicator device is preferably disposed at this bonded junction between member 26 and lens 24. The indicia may be embodied as a coating or film applied to either surface and then etched away or as a thin strip 28 bonded between the lens 24 and the member 26 in a laminated configuration. One or more rectangular filters 30, 32 and 34 are bonded together face-to-face and to the rear surface of projection 24*a* of lens 24 in a stacked relation. The peripheral configuration of the glass filters is coincident with the peripheral configuration of projection 24*a*. It is preferable in this exemplary embodiment to make lens 24 of a transparent plastic material which may be tinted to a desired color. Projection 20*a* is integral with lens 20, although it could be a separate piece bonded to the lens as is member 26. The bonding is preferably accomplished by ultrasonic welding or the like, but could be done by adhesives. The filters 30, 32 and 34 are preferably made of glass and bonded together and to lens 24 by a suitable adhesive.

A seal 36 is provided for the lens assembly 22. Seal 36 is an opaque elastomer sleeve such as a silicon rubber or the like having good elastic qualities. It comprises a sleeve portion 36*a* of substantially uniform thin wall thickness and an integral outwardly projecting peripheral flange 36*b* at the forward end thereof. A rectangular opening 36*c* extends completely through seal 36. In cross section, flange 36*b* comprises a bead having a rectangular mass which is significantly thicker than the wall thickness of sleeve portion 36*a*. Seal 36 is stretched over the rear projection 24*a* of lens 24 and the bonded filters 30, 32 and 34 such that a forward surface of flange 36*b* seats squarely against the rim formed at the back surface of lens 24 around the rear projection 24*a*. The flange 36*b* projects transversely beyond the edge surfaces of lens 24, while the sleeve 36*a* extends rearwardly around the filters as shown in FIG. 1. Seal 36 cooperates with lens 24 and the housing to centrally position and space the lens within the pocket and the opening 8*c* of bezel 8 and to provide a seal between the lens and the housing as more fully described in the afore-mentioned copending application Ser. No. 497,372.

Although the lamp mounting system of this invention has been described herein according to a preferred embodiment, it is to be understood that the invention is susceptible of various modifications without departing from the scope of the appended claims.

I claim:

1. An omnidirectional shock absorbing lamp mounting system comprising:

a lamp comprising a tubular glass envelope extending from one end of an enlarged body portion;

a first resilient member annularly disposed around said tubular envelope against said one end of said body;

a second resilient member disposed against a second end of said body portion opposite said one end; and housing means constraining said resilient members partly compressed against said ends of said lamp body portion, resiliently supporting said lamp between said resilient members.

2. The omnidirectional shock absorbing lamp mounting system defined in claim 1 wherein said housing means comprises an opening through which said tubular envelope projects and means positioning said first resilient member relative to said opening to maintain said tubular envelope spaced from edges of said opening.

3. The omnidirectional shock absorbing lamp mounting system defined in claim 2 wherein said first resilient member comprises an elastomer ring.

4. The omnidirectional shock absorbing lamp mounting system defined in claim 3 wherein said positioning means comprises means engaging an outer diameter of said ring preventing radial displacement of said ring and said lamp.

5. The omnidirectional shock absorbing lamp mounting system defined in claim 4 wherein said elastomer ring comprises a right cylinder and said positioning means comprises a cylindrical recess concentric with said opening.

6. The omnidirectional shock absorbing lamp mounting system defined in claim 5 wherein said second resilient member comprises an elastomer member.

7. Illuminated apparatus having an omnidirectional shock absorbing lamp mounting system comprising:

a reflector having an opening therethrough;

positioning means on a back surface of said reflector arranged concentrically with said opening;

a lamp having a generally cylindrical main body and a reduced diameter glass tube extending from one end of said body;

an annular elastomer member disposed around said glass tube and within said positioning means, opposite ends of said annular elastomer member bearing against said back surface of said reflector and said main body of said lamp; and means resiliently engaging an end of said lamp opposite said one end biasing said lamp body against said annular elastomer member.

8. The illuminated apparatus defined in claim 7 wherein said annular elastomer member cooperates with said positioning means for centering said glass tube within said opening.

9. The illuminated apparatus defined in claim 8 wherein said positioning means and said annular elastomer member cooperate to maintain said glass tube spaced from edges of said opening.

10. The illuminated apparatus defined in claim 9 wherein said positioning means comprises a counterbored recess in said back surface concentric with said opening.

11. The illuminated apparatus defined in claim 10 wherein said annular elastomer member comprises a right cylinder.

12. The illuminated apparatus defined in claim 11 wherein biasing said lamp body by said resilient means effects end-to-end compression of said annular elastomer member and radial bulging thereof into firm circumferential engagement with recess and said glass tube.

13. The illuminated apparatus defined in claim 12 wherein said resilient means is an elastomer.

14. The illuminated apparatus defined in claim 13 wherein said elastomer is rubber.

* * * * *